United States Patent [19]

Henkle

[11] 4,212,222

[45] Jul. 15, 1980

[54] VIOLIN SHOULDER REST

[76] Inventor: Ted Henkle, 5415 Reynolds Street, Savannah, Ga. 31405

[21] Appl. No.: 971,964

[22] Filed: Dec. 21, 1978

[51] Int. Cl.[2] ..... G10G 5/00; G10D 3/18

[52] U.S. Cl. ..... 84/278; 84/280

[58] Field of Search ..... 84/278–281

[56] References Cited

U.S. PATENT DOCUMENTS

| | | | |
|---|---|---|---|
| 925,068 | 6/1909 | Ziegler | 84/279 |
| 932,844 | 8/1909 | Beisheim | 84/280 |
| 1,570,361 | 1/1926 | Wallace | 84/279 |
| 3,727,509 | 4/1973 | Henkle | 84/280 |

FOREIGN PATENT DOCUMENTS

| | | | |
|---|---|---|---|
| 277350 | 11/1951 | Switzerland | 84/279 |

*Primary Examiner*—Lawrence R. Franklin

*Attorney, Agent, or Firm*—Allison C. Collard; Thomas M. Galgano

[57] ABSTRACT

An improved shoulder rest for an instrument and, in particular, a violin, viola, or the like, having a chin rest and a supporting clamp engaging a back portion of the instrument generally opposite the chin rest, is provided which includes a mounting base securable between the supporting clamp and the back portion of the instrument. An arm is detachably securable to the base at a number of different locations. A shoulder rest element which rests against the user's shoulder is, in turn, secured to the arm in such a manner so as to permit sliding, rotational, and tilting adjustable movement of the rest element relative to the arm. Thereafter, the shoulder rest element may be locked in the desired and stationary position of orientation relative to the arm.

5 Claims, 12 Drawing Figures

VIOLIN SHOULDER REST

This invention relates to a shoulder rest for an instrument and, in particular, for violins, violas, and the like.

More specifically, it relates to an improved shoulder rest for stringed instruments which includes a compressible shoulder rest element suitably supported for positioning between the back of the instrument and the shoulder section of the player to provide a lively resilience, enabling the player to support the instrument with little or no effort.

A very effective violin shoulder rest is disclosed in my prior U.S. Pat. No. 3,727,509. While satisfactory in use, this shoulder rest has been found to have a number of drawbacks. In particular, although it is provided with a number of adjustment features to allow the shoulder rest element to conform to the user's preference and physical characteristics, it does not afford universal adjustment in a simple and yet highly effective manner as herein proposed.

Accordingly, it is an object of the present invention to provide an improved shoulder rest element which allows multi-adjustment of the shoulder rest relative to the instrument.

It is also an object of the present invention to provide such a shoulder rest which is relatively simple in construction, compact, attractive, and comfortable to use.

It is a more particular object of the invention to provide such a shoulder rest having the foregoing attributes and characteristics which is relatively economical to fabricate, durable and reliable in operation.

Certain of the foregoing and related objects are readily attained in a shoulder rest for an instrument having a chin rest and a supporting clamp engaging a back portion of the instrument generally opposite the chin rest which includes a mounting plate securable between the supporting clamp and the back portion of the instrument. The shoulder rest further includes an arm and means for detachably securing the arm to the base at different locations along the length thereof. In addition, a shoulder rest element is provided as well as means for coupling the shoulder rest element to the arm which permits sliding, rotational and tilting movement of the rest element relative to the arm and which permits the rest element to be fixed in a desired stationary position relative to the arm.

Preferably, the mounting base has depending therefrom a generally arcuate mounting element having an elongated forward edge with a plurality of spaced-apart recesses formed therein and an elongated rear surface which defines a lip. To cooperate therewith, the arm includes an end portion having a generally hook-shaped flange configured and dimensioned for receipt within one of the recesses of the mounting element and a resilient coupling element spaced from the flange and configured for snap-fit engagement with the lip defined by the rear edge. The flange and coupling element cooperate with the forward and rearward edges of the mounting element, to thereby define the means for detachably securing the arm to the base.

Most advantageously, the arm has a longitudinal slot formed therein and the means for coupling includes a bolt, one end of which is secured to the shoulder rest element and the other end of which extends through the slot and is slidably coupled to the arm for sliding movement along the slot.

In a particularly preferred embodiment, the bolt is threaded and the shoulder rest element has a top surface and a bottom surface and a bore extending through the surfaces thereof through which the one end of the bolt extends. In addition, the means for coupling includes a nut threadably secured on the one end of the bolt opposite the lower surface of the shoulder rest element which is movable between a non-locking and locking position relative to the shoulder rest element so as to fix the position thereof.

In a particularly preferred embodiment, the arm has a base wall in which the slot is defined and the base wall has a longitudinally-extending concave upper surface. The means for coupling includes a bolt holder secured to the other end of the bolt having a convex lower surface which rests on the upper top surface of the base wall for longitudinal and lateral sliding movement relative to the slot formed therein. Most desirably, the arm has a longitudinally-extending convex lower surface and the means for coupling includes a saddle having a bore extending therethrough which is disposed between the arm and the shoulder rest element and which has a longitudinally-extending concave upper surface on which the lower surface of the arm rests to facilitate guiding of the arm during the sliding movement.

The shoulder rest element further advantageously includes a control disc coupled to the nut which facilitates tightening and loosening thereof so as to adjust the position of the shoulder rest element. Most desirably, the shoulder rest element has a lower surface to which a resilient pad is detachably secured.

Other objects and features of the present invention will become apparent from the following detailed description when taken in connection with the accompanying drawings which disclose one embodiment of the invention. It is to be understood that the drawings are designed for the purpose of illustration only, and are not intended as a definition of the limits and scope of the invention.

In the drawings, wherein similar reference characters denote similar elements throughout the several views.

Figure 1:
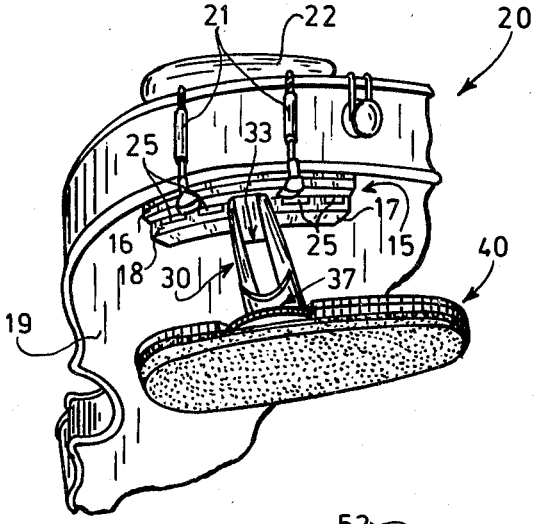
FIG. 1 is a fragmentarily-illustrated, perspective view of a violin fitted with a shoulder rest embodying the present invention.

Turning now in detail to the drawings, and, in particular, FIGS. 1–5 thereof, therein illustrated is a novel shoulder rest for a violin which includes an arcuately-shaped mounting plate or base 15 having laterally offset, horizontally-extending upper and lower wall portions 16 and 17, joined together by an intermediate wall portion 18. Secured atop wall portion 16 is an arcuately-shaped leather pad 13 which is intended to rest against the back or rear side 19 of a violin 20 so as to prevent damage thereto as well as to enable facile sliding adjustment of the mounting plate 15 and, in turn, the shoulder rest along the violin back to accommodate the user's preference and physical characteristics. Mounting plate 15 has five transverse recesses or pockets 25 formed in the outwardly-directed face of intermediate wall 18, the purpose of which will be described in greater detail hereinafter.

Mounting base 15 is secured to violin back 19 by a pair of turnbuckle clamps 21, each of which has an upper end which is secured to the chin rest 22 of the violin 20 and a lower, hook-shaped end which engages underneath the upper wall portion 16 of base plate 15. By tightening turnbuckle clamps 21, mounting plate 15 will be securely fastened against the violin back 19. Of course, the position of mounting plate 15 relative to violin back 19 can be easily adjusted by simply loosening turnbuckle clamps 21 and sliding mounting plate 15 along violin back 19 to the desired location at which point the clamps 21 would be retightened.

Figure 5:
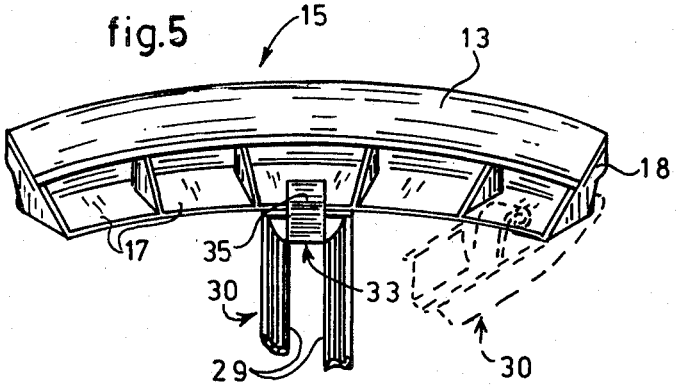
FIG. 5 is a perspective view of the shoulder rest mounting base and arm, which further shows in phantom view one of the alternate mounting positions of the arm.
Figure 3:
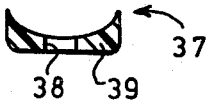
FIG. 3 is a cross-sectional view of the shoulder rest saddle.

The shoulder rest also includes an adjustment arm 30 having a forward end portion 31 with a recessed upper surface 32 which is dimensioned to permit mating engagement thereof with lower wall portion 17 of mounting plate 15. A steel spring clip 33 is incorporated in the forward end portion of arm 30. The spring clip, as seen best in FIGS. 1, 2, 5, and 6, has a hooked forward end 34 which extends over the front edge of recessed upper surface 32 and a curled rear end 35 which extends over the rear edge of recessed upper surface 32. In order to releasably secure arm 30 to plate 15, the hooked forward end 34 of clip 33 is initially placed into one of the pockets 25 formed in intermediate wall 18. Then, arm 30 is pivoted upwardly about its forward end so that the rear edge 14 of lower wall portion 17 is received in a snap-fit manner in recessed surface 32 beneath the resilient curled end 35 of clip 33. Release of arm 30 is effected in a reverse manner. As can be appreciated, and as best illustrated in FIG. 5, arm 30 can be mounted at various points along the length of mounting plate 15 due to the provision of a plurality of mounting pockets 25 in mounting plate 15.

Figure 4:
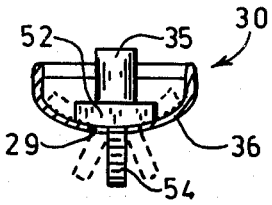
FIG. 4 is a cross-sectional view taken along lines 4—4 of FIG. 2, also showing in phantom-view two alternate tilting positions of the shoulder rest element bolt relative to the arm.

As seen most clearly in FIGS. 4–6, arm 30 also has a generally U-shaped cross-section and a concavely-shaped base wall 36 having a longitudinally-extending slot 29 formed therein, the purposes for which will be described in greater detail hereinafter. As seen best in FIGS. 1–3, base wall 36 rests upon saddle 37 which has an upper surface configured to complement the bottom surface of base wall 36 and an axial bore 38 extending therethrough. Saddle 37 has a flat, circular base wall 39 which rests upon a hollow, frustoconical embossment or fillet 41 of a generally elliptically-shaped shoulder rest element 40.

A generally circular control disc 42 having a knurled or serrated circumferential edge 43 is provided with a hollow cylindrical embossment 44 which is dimensioned to permit rotatable receipt thereof within the hollow interior (not shown) of embossment 41. Both embossments 41 and 44 have axial bores 45 and 46, respectively, formed therethrough which are in alignment with the axial bore 38 of saddle 36.

Figure 6:
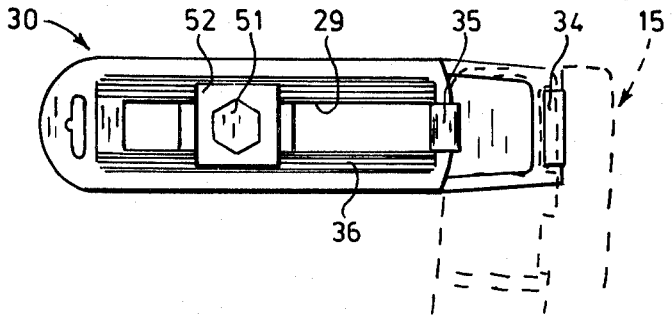
FIG. 6 is a top plan view of the shoulder rest arm and further showing a portion of the mounting base in phantom view.
Figure 7:
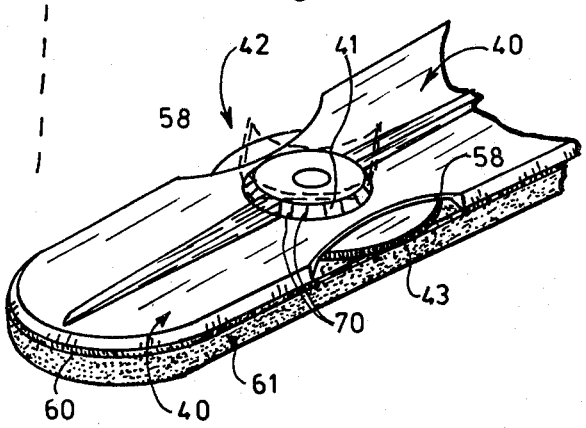
FIG. 7 is a fragmentarily-illustrated, perspective view of the shoulder rest element.
Figure 8:
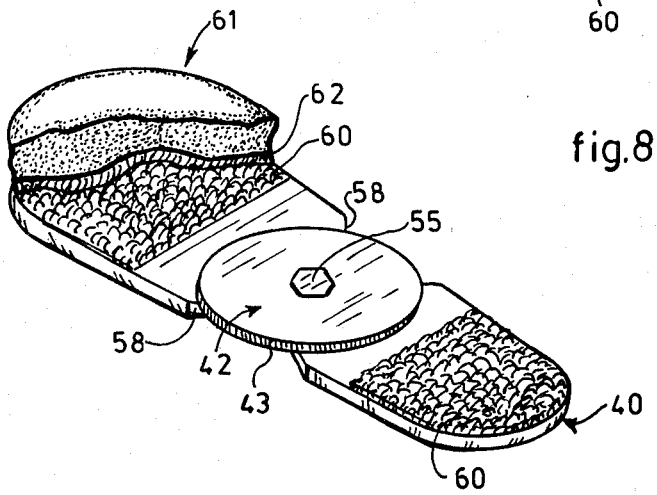
FIG. 8 is a further fragmentarily-illustrated, perspective view of the shoulder rest element, with portions broken away to show internal construction.

The shoulder rest further includes a threaded bolt 50 having a hexagonal bolt head 51 which is received with a complimentary-configured hexagonal recess of a bolt holder 52 as seen best in FIG. 6. Bolt holder 52 has a concavely-shaped lower surface (see FIG. 4) which is intended to rest upon the concavely-shaped base 36 of arm 30 with the threaded stem 54 of bolt 50 extending through the slot 29 of arm 30 and, in successive fashion, through axial bores 38, 45, and 46. A hexagonal nut 55 is threaded onto the free end of stem 54 and is received, in mating fashion, in a hexagonally-configured interior chamber of hollow embossment 44 of control disc 42. As a result, rotation or turning of control disc 42 about its axis will control tightening and loosening of nut 55 with respect to bolt 50. As can be seen in FIGS. 7 and 8, shoulder rest element 40 is provided with medial cutout or notched peripheral surfaces 58 to facilitate manual turning of control disc 42.

Figure 9:
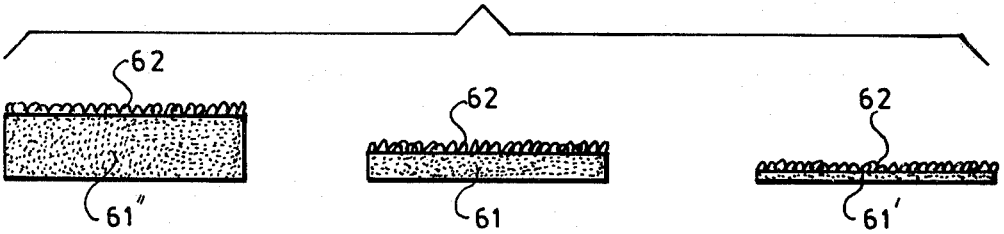
FIG. 9 is a side-elevational view of three cushion pads which may be secured to the shoulder rest element.

As illustrated in FIG. 8, the underside of shoulder rest element 40 has secured to each of the opposite ends thereof a Velcro loop fastening pad or tape 60. A cushioned pad 61 made of foam rubber or another suitable material and having a similar configuration to rest element 40 has secured to the upper surface thereof a Velcro hook fastening pad or tape 62. As a result, cushioned pad 61 may be detachably secured to shoulder rest element 40 by simply pressing its Velcro hook fastening tape 62 against the Velcro loop fastening pads 60 of shoulder rest element 40. As shown in FIG. 9, a plurality of cushion pads 61, 61', and 61'', may be provided having different thicknesses so as to suit personal preferences. In addition, the orientation of the pads 61 when attached to shoulder rest element 40 may be reversed.

Figure 10:
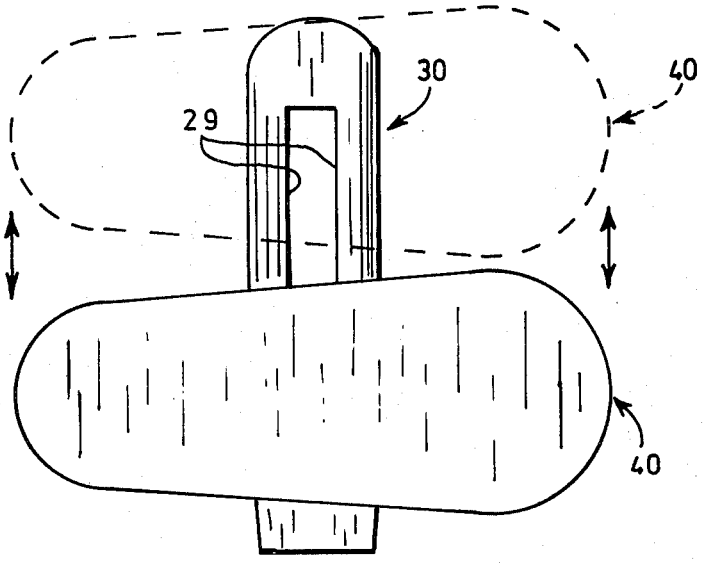
FIG. 10 is a schematic, bottom view of the shoulder rest showing the possible longitudinal sliding movement of the shoulder rest element relative to the shoulder rest arm.
Figure 11:
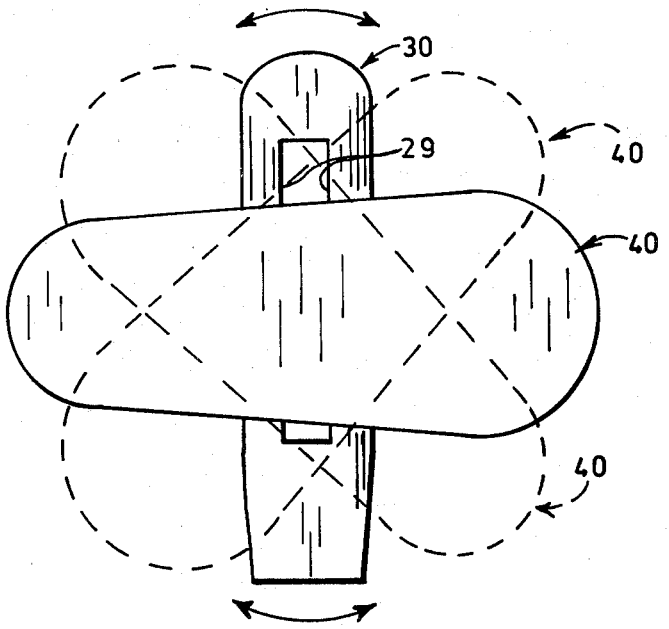
FIG. 11 is a schematic, bottom view of the shoulder rest comparable to that of FIG. 9, showing the possible rotational movement of the shoulder rest element relative to the arm.
Figure 12:
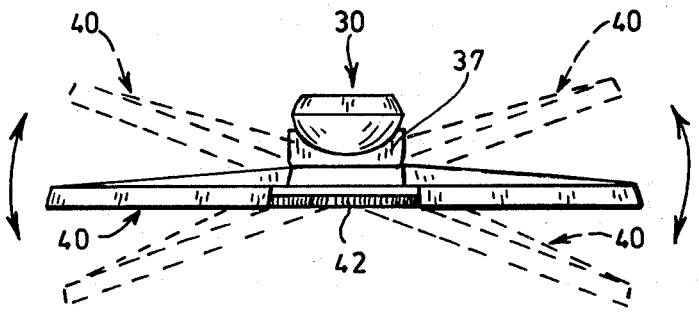
FIG. 12 is a schematic side elevational view showing the possible tilting movement of the shoulder rest element relative to the support arm.

When nut 55 is loosened by control disc 42, a variety of adjustments may be made. In particular, as shown in FIG. 10, the positioning of the shoulder rest element 40 at a particular point along the length of arm 30 may be adjusted by the permissible sliding action of bolt holder 52 and bolt 50 along slot 29 of base wall 36. In addition, as shown in FIG. 11, shoulder rest element 40 may be rotated about bolt 50 and so as to vary its angular position relative to arm 30. Furthermore, as shown in FIGS. 4 and 12, as a result of the concave configuration of base wall 36, and the complimentary configured bottom surface of bolt holder 52, as well as the provision of a slot 29 having a greater width than the diameter of bolt stem 54, bolt 50 and, in turn, shoulder rest element 40 may be tilted to conform to the shoulder slope of the user.

Figure 2:
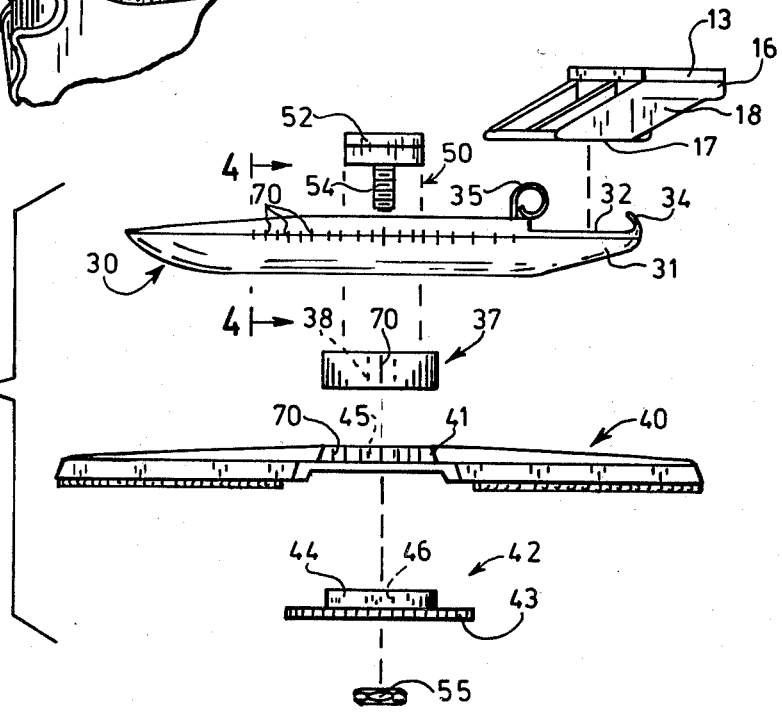
FIG. 2 is an enlarged, exploded, side elevational view of the shoulder rest element shown in FIG. 1.

Once the desired adjustments are made, the control disc 42 would be turned to tighten nut 55 thereby locking shoulder rest element 40 in a fixed position relative to arm 30. As shown in FIG. 2, it is preferable to place scale markings 70 on the sides of arm 30, saddle 36, and embossment 41, so that the user can readily adjust the violin rest to his or her preferred orientation.

As can be appreciated, many changes and modifications may be made as will be apparent to those skilled in the art. For instance, although it has been found helpful to use a saddle to support the arm in a desired position, such is not essential and may be omitted so as to advantageously lower the construction height of the shoulder rest element. In addition, although the various parts (aside from the spring clip) of the shoulder rest are preferably fabricated from plastic materials, other suitable materials may be used. Furthermore, the shoulder rest could be secured to the back of the instrument by other conventional means.

Thus, while only one embodiment of the present invention has been shown and described, it will be obvious to those persons of ordinary skill in the art that many changes and modifications may be made thereunto, without departing from the spirit and scope of the invention.

What is claimed is:

1. A shoulder rest for an instrument having a chin rest and a supporting clamp engaging a back portion of the instrument generally opposite the chin rest, comprising:

an elongated mounting base securable between said supporting clamp and said back portion of the instrument;

an arm having a longitudinal slot formed therein;

means for detachably securing said arm to said base at different locations along the length of said base;

a shoulder rest element having a top surface and a bottom surface and a bore extending through said surfaces thereof; and means for coupling said shoulder rest element to said arm which permits sliding, rotational and tilting movement of said rest element relative to said arm and which permits the rest element to be fixed in a desired and stationary position relative to said arm, said means for coupling including a threaded bolt, one end of which extends through said bore of said shoulder rest element and the other end of which extends through said slot and is slidably coupled to said arm for sliding movement along said slot thereof, and a nut threadably secured on said one end of said bolt opposite said lower surface of said shoulder rest element, said nut being movable between a non-locking position in which it permits sliding movement of said bolt and, in turn, said shoulder rest element, along the length of the slot and rotational movement of said shoulder rest element about said bolt and, in turn, said arm, and a locking position, in which it secures the shoulder rest element in a fixed position relative to said arm, said nut having a control disc in engagement therewith which facilitates tightening and loosening of the nut so as to permit the sliding, rotational and tilting movement adjustments of the position of said shoulder rest element relative to said arm to be controlled exclusively by said control disc.

2. The shoulder rest according to claim 1, wherein said mounting base has depending therefrom a generally arcuate mounting element having an elongated forward edge with a plurality of spaced-apart recesses formed therein and an elongated rear surface which defines a lip and wherein said arm includes an end portion having a generally hook-shaped flange configured and dimensioned for receipt within one of said recesses of said mounting element and a resilient coupling element spaced from said flange and configured for snap-fit engagement with said lip defined by said rear edge, said flange and said coupling element cooperating with said forward and rearward edges of said mounting element to define said means for detachably securing said arm to said base.

3. The shoulder rest element according to claim 1, wherein said arm has a base wall in which said slot is defined wherein said base wall has a longitudinally-extending concave upper surface and wherein said means for coupling includes a bolt holder secured to said other end of said bolt having a convex lower surface which rests on said top surface of said base wall for longitudinal and lateral sliding movement relative to the slot formed thereof.

4. The shoulder rest element according to claim 3, wherein said arm has a convex lower surface and wherein said means for coupling includes a saddle element which is disposed between said arm and said shoulder rest element and which has a bore extending therethrough which said bolt passes, said saddle element having a concave upper surface on which said lower convex surface of said arm rests.

5. The shoulder rest according to claim 1, wherein said shoulder rest element has a lower surface to which a resilient pad is detachably secured.

* * * * *